US005101993A

United States Patent [19]

Nairn et al.

[11] Patent Number: 5,101,993

[45] Date of Patent: Apr. 7, 1992

[54] CLOSURE SEAL

[75] Inventors: James F. Nairn, St. Charles; Richard J. Petro, Mokena, both of Ill.

[73] Assignee: Phoenix Closures, Inc., Naperville, Ill.

[21] Appl. No.: 521,697

[22] Filed: May 10, 1990

[51] Int. Cl.[5] ..... B65D 51/00

[52] U.S. Cl. ..... 215/232; 215/344; 215/341

[58] Field of Search ..... 215/232, 341, 344, 233; 222/568, 569, 570

[56] References Cited

U.S. PATENT DOCUMENTS

| | | | |
|---|---|---|---|
| 2,715,480 | 8/1955 | Livingstone | 222/568 |
| 2,768,762 | 10/1956 | Guinet . | |
| 3,074,579 | 1/1963 | Miller . | |
| 3,180,534 | 4/1965 | Duda et al. . | |
| 3,203,571 | 8/1965 | Plunkett . | |
| 3,215,297 | 11/1965 | Acton et al. . | |
| 3,232,470 | 2/1966 | Gibson . | |
| 3,255,907 | 6/1966 | Eddy . | |
| 3,286,866 | 11/1966 | McIntosh . | |
| 3,339,773 | 9/1967 | Stull . | |
| 3,360,149 | 12/1967 | Roth . | |
| 3,435,975 | 4/1969 | Weigand . | |
| 3,463,340 | 8/1969 | Lindstrom . | |
| 3,482,725 | 12/1969 | Exton . | |
| 3,532,244 | 10/1970 | Yates . | |
| 3,536,224 | 10/1970 | Green | 215/344 |
| 3,568,871 | 3/1971 | Livingstone . | |
| 3,770,156 | 11/1973 | Pates | 215/344 |
| 3,802,590 | 4/1974 | Culver . | |
| 3,815,771 | 6/1974 | Marks . | |
| 3,844,439 | 10/1974 | Demers et al. . | |
| 3,871,545 | 3/1975 | Bereziat . | |
| 3,888,373 | 6/1975 | Gach et al. | 215/344 |
| 3,979,001 | 9/1976 | Bogert . | |
| 4,032,492 | 7/1977 | Anglund et al. | 215/233 |
| 4,084,716 | 4/1978 | Bogert . | |
| 4,143,785 | 3/1979 | Ferrell . | |
| 4,241,864 | 12/1980 | Kessler | 215/233 X |
| 4,276,989 | 7/1981 | Hicks . | |
| 4,442,947 | 4/1984 | Banich, Sr. . | |
| 4,550,862 | 11/1985 | Barker et al. | 222/568 |
| 4,556,603 | 1/1985 | Moore . | |
| 4,560,077 | 12/1985 | Dutt . | |
| 4,697,716 | 10/1987 | Mumford | 215/341 |
| 4,706,829 | 11/1987 | Li | 222/570 |
| 4,844,273 | 7/1989 | Hawkins | 215/341 |
| 4,844,302 | 7/1989 | Lay | 222/568 |
| 4,907,709 | 3/1990 | Abe et al. | 215/344 |
| 4,955,504 | 9/1990 | Lesscher | 215/344 |

FOREIGN PATENT DOCUMENTS

| | | |
|---|---|---|
| 1185078 | 1/1965 | Fed. Rep. of Germany . |
| 1782178 | 7/1971 | Fed. Rep. of Germany . |
| 667287 | 9/1964 | Italy . |
| 201102 | 1/1966 | Sweden . |
| 564461 | 7/1975 | Switzerland . |

*Primary Examiner*—Gary E. Elkins
*Assistant Examiner*—Paul A. Schwarz
*Attorney, Agent, or Firm*—Welsh & Katz, Ltd.

[57] ABSTRACT

A closure seal for sealing a closure to a container land surface includes the application of a sealing material to the land surface just prior to the engagement of the closure and the land surface so that the sealing material may fill in any gaps, imperfections, or misalignments between the land surface and the opposing surface of the closure. In addition, the underside of the annular portion may be provided with a plurality of depending, variable length annular sealing beads which engage the land surface to effect a leak-proof seal.

6 Claims, 4 Drawing Sheets

CLOSURE SEAL

BACKGROUND OF THE INVENTION

The present invention relates to closures for containers, and specifically relates to a closure having a portion with a surface which engages the land surface of the container in a manner which prevents the unwanted escape or leakage of the container contents.

Conventional closures often are provided with some sort of formation for preventing the leakage of container contents, and such formations may take the form of gaskets, liners, annular sealing ribs, or other accepted sealing devices. Depending on the type of closure and/or the application, the efficiency of a particular sealing device may vary.

Conventional dispenser closures used for pouring the container contents often consist of three components, an inner sleeve which is friction-fit to the inside of the neck of the container, a spout portion which is either snap-fit into, or integrally formed with, the sleeve so that the spout projects vertically beyond the upper margins of the sleeve and the container neck, and a cap portion which is threaded onto the neck and may often serve as a measuring cup. This type of closure is commonly used for containers of liquid household laundry detergent and related products, although the closure seal of the invention is not restricted to any specific type of application.

A significant disadvantage of conventional dispenser closures is that the friction fitting of the closure over a container often results in an imperfect seal, due to variations in the land surface of the container. This problem is particularly prevalent when injection molded closures are used in combination with blow-molded bottles, in that the latter are inherently prone to variations in the land surface which may not provide a proper surface for sealing the closure thereon.

Although the application of sealing materials to the closure prior to assembly is known, such application has not been effective in solving the above-identified leakage problems. This is due in part to the fact that the sealing material often loses its resiliency or deformability prior to assembly.

Thus, there is a need for a container closure, and a method for securing such a closure upon a container, so that an underside surface of the closure, such as the above-described base portion, is sealingly secured to the land surface of the container to prevent the leakage of container contents, especially during pouring or inversion of the container.

SUMMARY OF THE INVENTION

Accordingly, the closure seal of the invention includes a layer of resilient or caulk-like sealing material disposed upon the land surface of the container just prior to assembly of the closure thereupon, so that the sealing material may fill in any imperfections or misaligned areas between the land surface and the corresponding surface of the closure while the material is still pliable and deformable.

The sealing material may be an adhesive or a solvent, or may be removable as a liner upon setting. The land-engaging surface of the closure may further include a plurality of depending, variable length annular sealing beads which enhance the sealing characteristics of the closure, and which may provide anchoring points for the sealing material. In some applications, one of the sealing beads will be longer than the others, and the position of the longer bead relative to the other beads may be changed as desired.

DESCRIPTION OF THE PREFERRED EMBODIMENT

Figure 1:
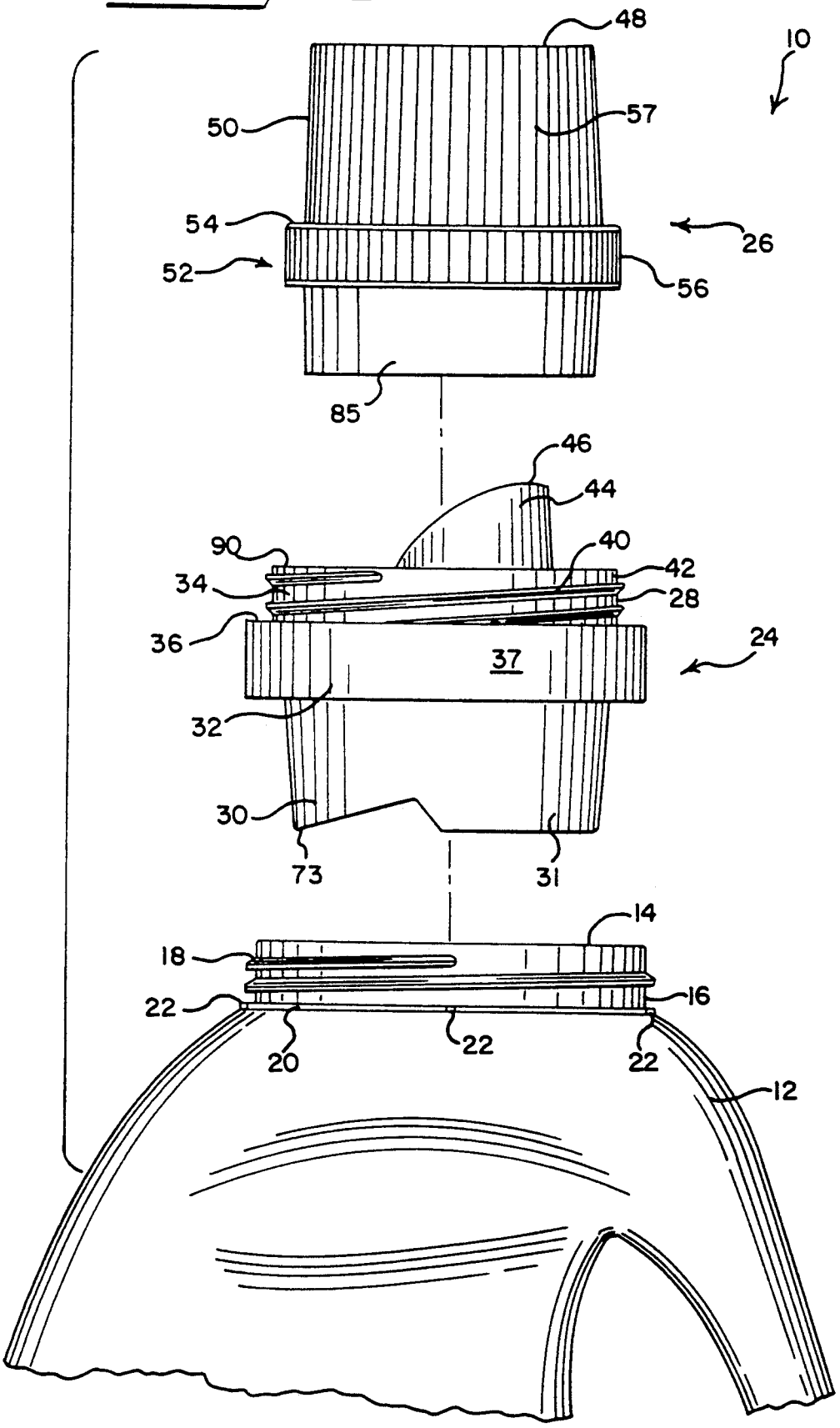
FIG. 1 is an exploded side elevational view of the closure of the type incorporating the present invention and a corresponding container.

Referring now to FIG. 1, a closure of the type which may incorporate the present closure seal is generally designated 10 and is shown exploded from a container 12. The container 12 includes a land surface 14 defined by an upper edge of a neck 16 having threads 18 on an exterior surface thereof. A radially projecting peripheral shoulder 20 is located at the base of the neck 16 and may be preferably provided with a plurality of locking formations 22. The container 12 may be manufactured of glass or a suitable polymeric material, such as polypropylene, the specific material depending on the substance to be filled into the container 12. If the container 12 is made of polymeric material, it may be produced by any of variety of polymeric production techniques; however, it is preferred that, for the purposes of the present invention, the container be blow molded. This preference is mainly due to cost considerations, for blow-molded containers have inherent production-induced variations, specifically in the land surface area, which have caused difficulty in sealingly securing conventional closures thereto.

Figure 6:
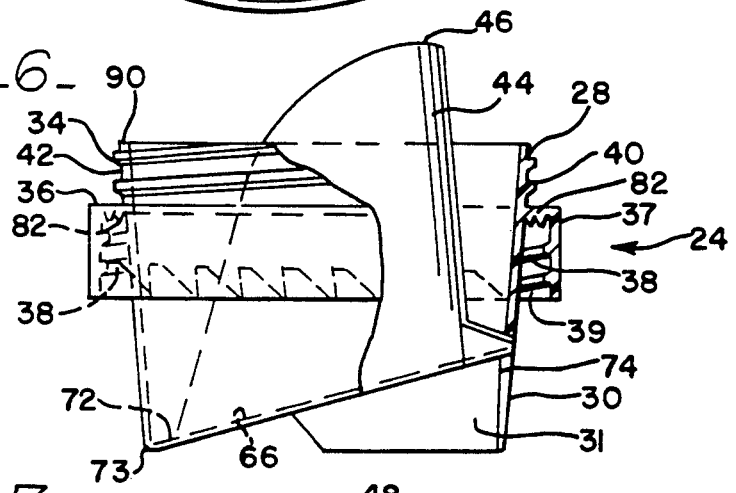
FIG. 6 is a vertical sectional view of the spout portion shown in FIG. 3 with portions broken away for clarity.

The closure 10 includes a base portion 24 and a cap portion 26, both of which may be made of a suitable polymeric material, such as polypropylene or polyethylene, however the use of other materials is contemplated. The base portion 24 has an annular wall 28 with a lower end 30, a central part 32 and an upper end 34. The lower end 30 is dimensioned to be inserted into the container mouth 35 defined by the land surface 14, and may be provided with at least one, and preferably two, leveling legs 31. A radially projecting peripheral or annular shoulder 36 is located at the central part 3 and is preferably provided with a depending skirt 37. The skirt 37 is provided with threads 38 on an interior surface 39 (best seen in FIG. 6). The skirt 37 is configured to threadably engage the threaded container neck 16, and the threads 18, 38 are arranged so that when the base portion 24 is secured on the neck 16, the lip 46 will face a front end of the container 12 for effective pouring. The upper end 34 of the wall 28 is provided with threads 40 on an external surface 42.

Figure 4:
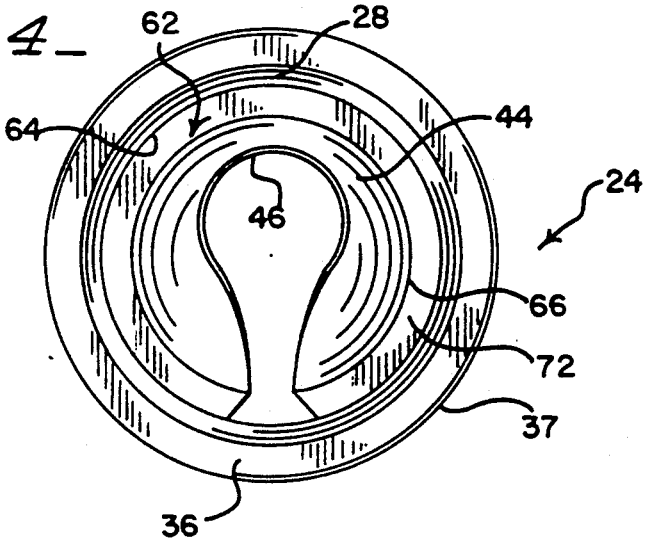
FIG. 4 is an overhead plan view of the spout portion shown in FIG. 3.
Figure 5:
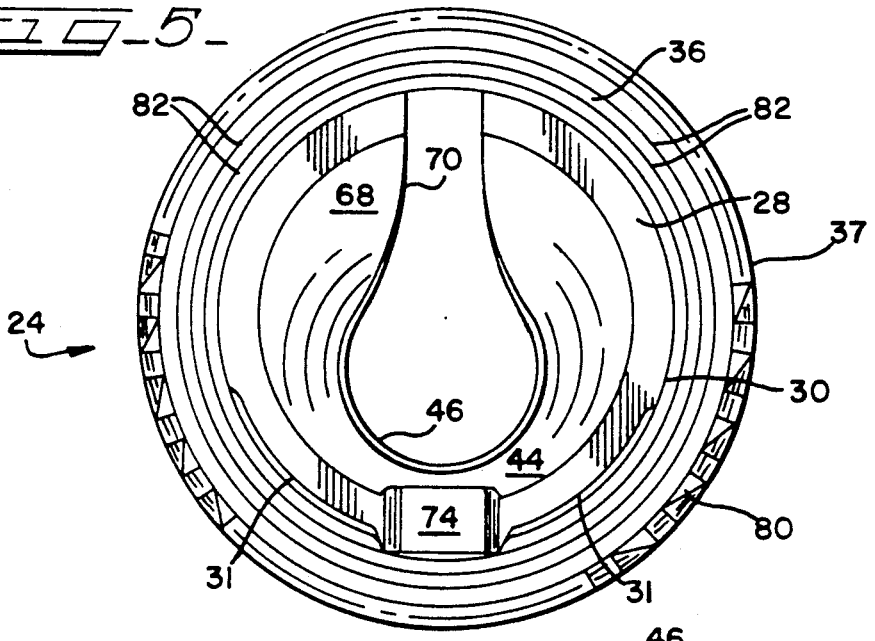
FIG. 5 is a bottom plan view of the spout portion shown in FIG. 3.

A controlled release formation such as a spout 44 having a lip 46 is disposed within an area defined by the annular wall 28, although other types of controlled release or dispensing formations are contemplated. The spout formation 46 is integral with the base portion 24 (best seen in FIG. 4), which is preferably molded as a single piece.

Figure 7:
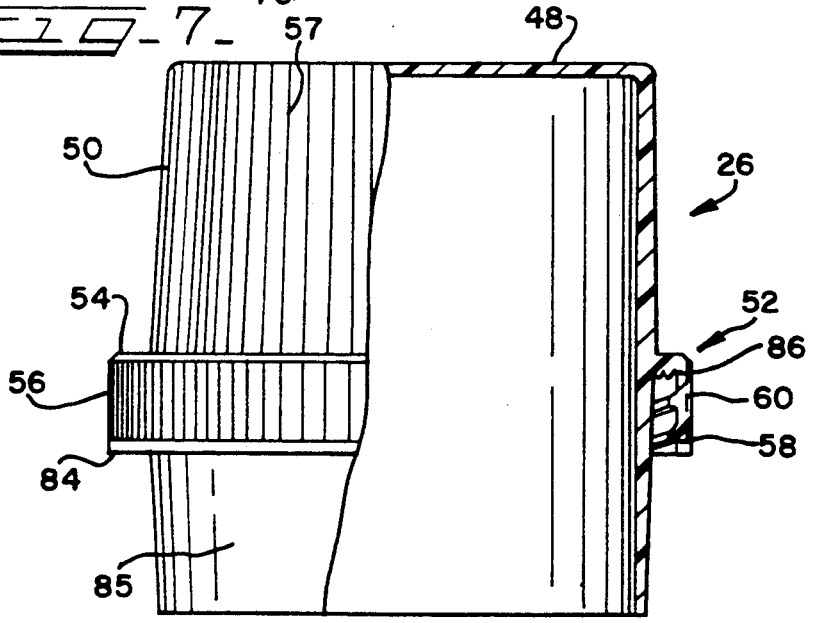
FIG. 7 is a side elevational view of the cap portion shown in FIG. 1, with portions broken away for clarity.

The cap portion 26 includes a closed top 48, a generally tubular wall 50 depending from the top and having a lower end 52, the lower end being provided with a radially projecting annular shoulder 54 having a depending collar 56. In the preferred embodiment, the tubular wall 50 has a plurality of spaced, generally parallel, external gripping ribs 57. The collar 56 is provided with threads 58 on an interior surface 60 (best seen in FIG. 7). The threaded interior surface 60 is configured to threadably engage the exterior surface 42 of the wall 28.

Figure 2:
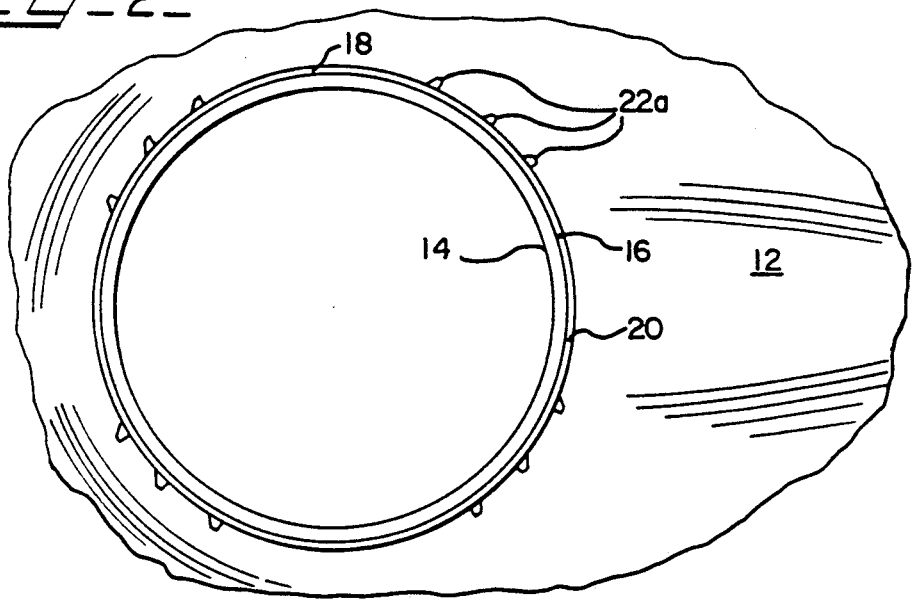
FIG. 2 is an overhead plan view of an alternate embodiment of the neck of the container shown in FIG. 1.
Figure 3:
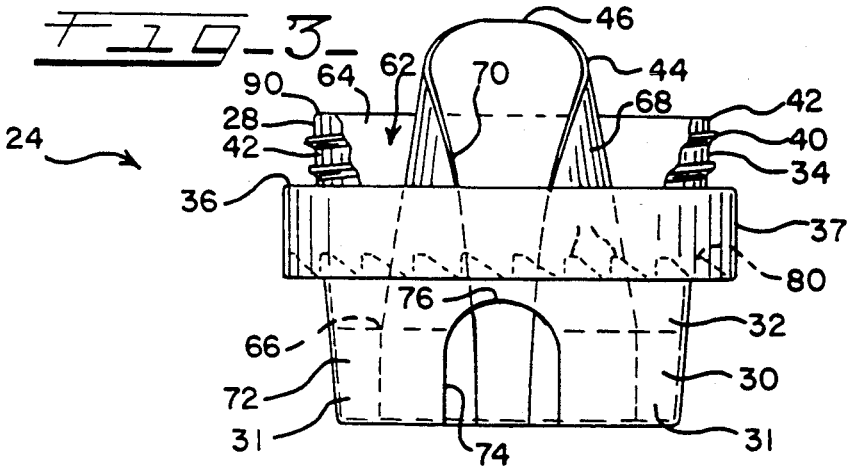
FIG. 3 is an elevational view of the rear of the spout portion of the closure shown in FIG. 1 with portions broken away for clarity.

Referring now to FIG. 2, an alternate embodiment of the container neck 16 is depicted in which a plurality of tooth-shaped formations **22*a*** are shown provided in four groups of three. However, the use of any number of shapes and/or disposition of locking formations is contemplated.

Referring now to FIGS. 3 through 6, the base portion 24 is shown in greater detail. The annular wall 28 defines an interior portion 62 having an inner surface 64. The spout formation 44 is disposed within the inner portion 62 and is generally frusto-conical in shape. The lip 46 is located at an upper end of the formation 44, which then gradually curves downwardly to a base 66. One side 68 of the formation 44 is generally open along a vertical line between the lip 46 and the base 66 and defines a slot 70.

The base 66 of the formation 44 is inclined and configured so as to be integral with a floor 72 of the base portion 24. The floor 72 is inclined to enable the drainage of any excess or residual material, usually liquid, from the spout formation 44 back into the container 12 once the container resumes its normal vertical post-pouring position. For this reason, the floor 72 actually acts as a gutter or trough to catch liquid draining from the spout 44 or the inner surface 64 of the wall 28 and to enable that material to flow downward along the floor 72 and through the slot 70 into the container 12. The leveling legs 31 form a tripod with a lower end 73 of the floor 72 to maintain the base portion 24 in an upright position, thus facilitating manipulation by vertically-oriented automatic handling equipment.

In order to prevent the retention of container contents within the base portion 24 when the container 12 is inverted in a pouring position, the annular wall 28 is provided with a drainage opening 74 which is in communication with the spout formation 44 and the interior of the container 12. The opening 74 preferably has an upper end 76 which is substantially coextensive with the lower edge of the skirt 37. In this manner, when the container 12 is inverted for pouring, any residual liquid will be able to flow through the opening 74 and out the spout 44. The opening 74 is preferably located opposite the slot 70 on the spout formation 44.

In the preferred embodiment, the interior surface 39 of the skirt 37 is provided with a plurality of ratchet teeth 80. The ratchet teeth 80 are configured to engage the locking formations 22, **22*a* as the base portion 24 is threaded upon the neck 16 of the container 12. The shoulder 36 is preferably provided on an underside with at least one annular sealing bead 82 (best seen in FIG. 6) which may be integrally molded with the base portion 24**.

Referring now to FIGS. 8–11, it has been found that when the base member 24 is secured to the neck 16 only by threaded engagement of the threads 38 and 18, there may be a chance for the contents of the container 12 to leak from the area of engagement of the land surface 14 and the underside of the shoulder 36. This leakage has been found to occur despite the presence of the beads 82, and has been thought to be caused by variations in the configuration of the land surface 14 of individual containers 12. Such variations often occur when the container 12 is a blow molded plastic bottle, which, unlike the injection molded base and cap portions 24, 26, is inherently difficult to produce to close tolerances. More specifically, the land surface 14 is often provided with an uneven surface (best seen in phantom in FIG. 8) which does not allow the beads 82 (best seen in FIG. 6) to make sufficient sealing contact with the land surface.

Figure 11:
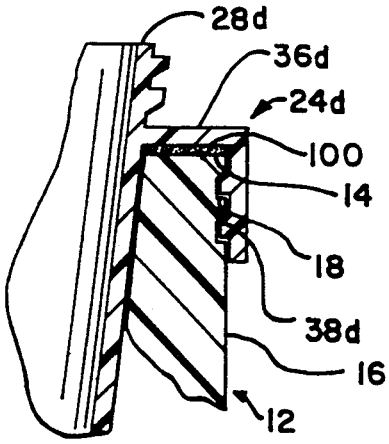
FIG. 11 is a fragmentary vertical sectional view of an alternate embodiment of the closure of FIG. 8 shown engaged with a container.
Figure 12:
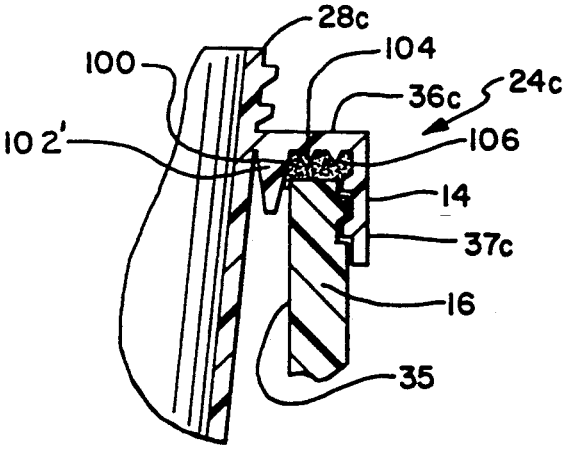
FIG. 12 is a fragmentary vertical sectional view of an alternative embodiment of the closure of FIG. 10 shown engaged with a container.

In an effort to correct this problem, the base portion 24 of the closure 10 of the invention is secured to the land surface 14 of the container 12 by means of a sealing material 100, such as an adhesive, solvent, or other type of resilient caulk-like material (best seen in FIG. 11). The sealing material 100 should be of the type which is viscous or pliant when applied, and may be any conventional product which is capable of sealing plastics together, including, but not limited to, thermoplastic-type hot melt adhesives composed of polymers such as polyamides, polyesters, ethylene-vinyl acetate copolymers, and polyethylene. If a solvent is employed, it will be of the type which slightly dissolves adjacent surfaces to form a strong bond. In the event that the closure 10 and the container 12 are used to contain food products, an FDA approved adhesive or solvent may be employed.

In addition to the use of the sealing material 100, the base portion 24 may be provided in different configurations, depicted in FIGS. 8–12 and identified as reference numbers **24*a*, 24*b*, 24*c* and 24*d*, respectively. In all four cases, components which are identical to the components of FIG. 6** will be given identical reference numbers, with the addition of the subscripts (a), (b), (c) or (d) where appropriate.

Figure 8:
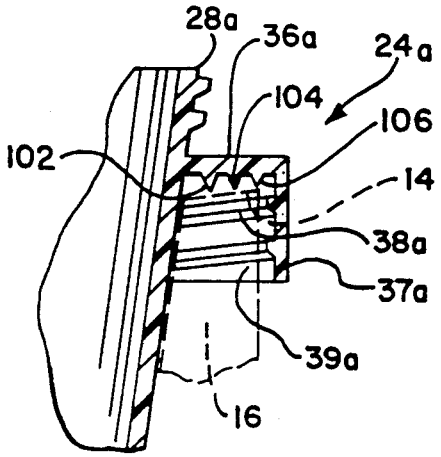
FIG. 8 is a fragmentary vertical sectional view of the present closure, which is an alternate embodiment of FIG. 6.

Referring now to FIG. 8, instead of the plurality of generally uniformly-dimensioned, annular sealing beads 82, the underside of the shoulder **36*a* is provided with a longest, preferably wedge-shaped sealing bead 102 which is shown located closely adjacent the annular wall 28*a*, a mid-length wedge-shaped bead 104, and a relatively shorter wedge-shaped bead 106 disposed closer to the inner face 39*a* of the skirt 37*a*. Although the beads 102, 104 and 106 are shown wedge-shaped, other shapes are contemplated. The beads 102, 104 and 106 provide an irregular surface which increases the chances that at least one of the beads will contact the land surface 14, and also facilitates adhesion between the land surface and the base portion 24***a*. In all other respects, the base portion 24*a* is identical to the base portion 24.

Figure 9:
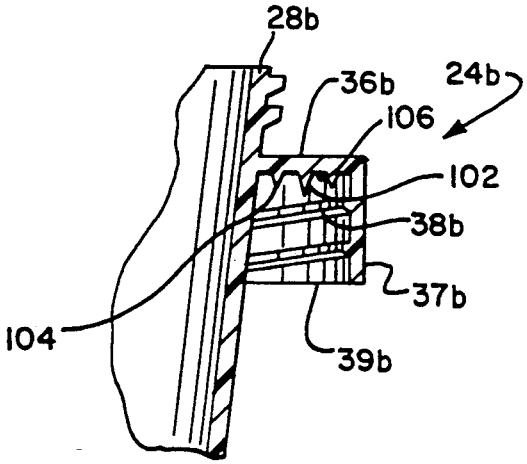
FIG. 9 is a fragmentary vertical sectional view of an alternate embodiment of the closure of FIG. 8.

Referring now to FIG. 9, an alternate embodiment of the base portion 24*a* is indicated as 24*b*. In the base portion 24*b*, the underside of the shoulder 36*b* is configured so that the longer bead 102 is disposed between the mid-length bead 104 and the shortest bead 106. The base portion 24*b* is presented to illustrate that the number, arrangement and relative length of the sealing beads 102, 104, and 106 may vary depending on the application. In all other respects, the base portion 24*b* is identical to the base portion 24.

Figure 10:
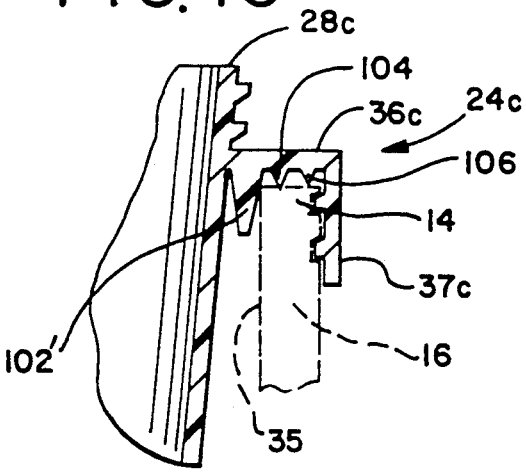
FIG. 10 is a fragmentary vertical sectional view of an alternate embodiment of the closure of FIG. 8.

Referring now to FIG. 10, a second alternate embodiment of the base portion 24*a* is indicated as 24*c*. In this embodiment, the underside of the shoulder 36*c* is provided with the longest bead 102' constructed and arranged to be extra long so as to be inserted into the mouth 35 as the neck 16 is threaded into the skirt 36*c*. The mid-length and shortest beads 104, 106, respectively, are located in similar positions to that described above in relation to FIG. 8.

Referring now to FIG. 11, a third alternate embodiment of the base portion 24*a* is indicated as 24*d*. The principal differentiating characteristic of base portion 24*d* is the absence of any depending sealing beads 102, 104, 106, so that the underside of the shoulder 36*d* is substantially planar. Thus, only the layer of sealing material 100 acts to secure the base portion 24*d* to the land surface 14. FIG. 11 also depicts the assembled relationship of the base portion 24*d* with the container neck 16, the land surface 14, as well as the adhesive 100.

The base portions 24*a*, 24*b*, 24*c* and 24*d* are preferably assembled in the following manner. First, the land surface 14 is covered with a layer of the sealing material 100, such as by being automatically or manually rolled on. A significant advantage of the present method is that the sealing material 100 is applied to the land surface 14 at a stage in the production/container filling process which is just prior to the assembly of the closure 10 and the container 12. Due to the "fresh" nature of the sealing material, it retains its resiliency and deformability at the time when it is needed most, i.e., at the point of engagement between the land surface 14 and the opposing surface of the closure 10. Next, the base portion 24 is threaded upon the neck 16 until the land surface 14 seats against the underside of the shoulder 36. The sealing material 100 then fills in any gaps, imperfections, or misaligned areas between the land surface 14 and the underside of the shoulder 36.

If it is an adhesive, the sealing material 100 may integrally bond the base portion 24 to the land surface 14, thus providing a closure seal which prevents the leakage of container contents, and which may prevent the removal of the closure 10 from the container 12. It is also contemplated that upon setting or drying, the sealing material 100 may be removable as a liner upon the opening of the closure 10. The use of variable length sealing beads, 102, 104, 106 may enhance the sealing characteristics of the closure in certain applications by providing anchoring points for the sealing material 100.

While a particular embodiment of the closure seal of the invention has been shown and described, it will be appreciated by those skilled in the art that changes and modifications may be made thereto without departing from the invention in its broader aspects and as set forth in the following claims.

What is claimed is:

1. A closure seal for a blow-molded plastic container, comprising:

a closure base portion having a depending skirt with a threaded inner surface and a base portion surface constructed and arranged for engagement with a land surface of the container, said base portion surface having a plurality of annular sealing beads depending therefrom, an inner one of said sealing beads positioned farthest from said skirt being of substantially greater length than the remaining, relatively shorter beads, and arranged to depend vertically from the closure surface for insertion into a container mouth defined by the land surface as said base portion is attached to the container with the assistance of said threaded inner surface, said remaining relatively shorter beads disposed on said base portion surfaces to directly engage the land surface of the container; and a layer of sealing material applied only to the land surface in a pliable state so as to fill in any gaps or misaligned portions upon the engagement of the land surface with said base portion surface and at least two of said relatively shorter annular beads to permanently bond said closure base portion to the container.

2. The closure as defined in claim 1 wherein said sealing material is a resilient, caulk-like adhesive.

3. The closure as defined in claim 1 wherein said sealing material is a sealing solvent which forms an integral bond between the closure and the land surface of the container.

4. In a container closure having a base portion with a formation for the controlled release of contents of a blow-molded plastic container, and cap portion configured for releasable sealing attachment to the base portion, the base portion having a skirt with a threaded inner surface and being constructed and arranged for attachment to a land surface of the container, the improvement comprising:

an annular portion of the base portion having an underside for direct engagement with the container land surface and including a plurality of annular sealing beads of variable length which vertically depend from said underside of said annular portion, said beads including a longest bead being positioned farthest from said skirt and being substantially greater in length than said remaining relatively shorter beads for insertion into said container as said base portion is attached to the container with the assistance of said threaded inner surface of said skirt, said remaining relatively shorter beads disposed on said base portion surfaces to directly engage the land surface of the container; and a layer of sealing material applied only between the land surface and said underside of said annular portion in a pliable state so as to fill in any gaps or misaligned portions upon the engagement of the land surface with said closure surface and at least two of said relatively shorter annular beads, for sealing and permanently bonding said underside to the container land surface to prevent the escape of container contents from said container other than from the controlled release formation.

5. The closure as defined in claim 4 wherein said means for sealing is an adhesive.

6. The closure as defined in claim 4 wherein said means for sealing and securely bonding is a sealing solvent which forms an integral bond between the closure and the land surface of the container.

* * * * *

UNITED STATES PATENT AND TRADEMARK OFFICE

CERTIFICATE OF CORRECTION

PATENT NO. : 5,101,993
DATED : April 7, 1992
INVENTOR(S) : James F. Nairn and Richard J. Petro It is certified that error appears in the above-identified patent and that said Letters Patent is hereby corrected as shown below:

Column 1,
Line 3, the number "3" should be -- 32 --.

Signed and Sealed this

First Day of January, 2002

*Attest:*

*Attesting Officer*

JAMES E. ROGAN
*Director of the United States Patent and Trademark Office*